US005645944A

United States Patent [19]

Leichtfried et al.

[11] Patent Number: 5,645,944

[45] Date of Patent: Jul. 8, 1997

[54] APPLICATION OF MOLYBDENUM ALLOYS

[75] Inventors: Gerhard Dipl-Ing Leichtfried, Reutte; Hans-Peter Martinz, Hofen, both of Austria

[73] Assignee: Schwarzkopf Technologies Corp., New York, N.Y.

[21] Appl. No.: 503,598

[22] Filed: Jul. 18, 1995

[30] Foreign Application Priority Data

Aug. 1, 1994 [AT] Austria ..... 1511/94

[51] Int. Cl.[6] ..... C22C 27/00

[52] U.S. Cl. ..... 428/469; 428/698; 428/457; 148/212; 148/238; 148/317; 148/423; 420/429

[58] Field of Search ..... 428/698, 457, 428/469; 148/210, 212, 237, 238, 316, 317, 423; 420/429

[56] References Cited

U.S. PATENT DOCUMENTS

| | | | |
|---|---|---|---|
| 3,701,655 | 10/1972 | Rausch et al. | 25/174 |
| 3,791,799 | 2/1974 | Heitzinger | 29/182.5 |
| 3,801,381 | 4/1974 | Van Thyne et al. | 148/31.5 |
| 3,830,670 | 8/1974 | Van Thyne et al. | 148/31.5 |
| 3,994,692 | 11/1976 | Rudy | 29/182.5 |
| 4,026,730 | 5/1977 | Van Thyne et al. | 148/31.5 |
| 4,799,977 | 1/1989 | Rausch | 148/317 |

FOREIGN PATENT DOCUMENTS

| | | |
|---|---|---|
| 1758508 | 3/1971 | Germany . |
| 2064674 | 2/1972 | Germany . |
| 1758923 | 4/1972 | Germany . |
| 1758924 | 8/1973 | Germany . |
| 1560617 | 4/1990 | U.S.S.R. . |

OTHER PUBLICATIONS

*The Carburization and Nitriding of Molybdenum and TZM*, Hans–Peter Martinz, Klaus Prandini, Proceedings of the 13th International Plansee Seminar, (1993), vol. 1, pp. 632–649.

*Primary Examiner*—Archene Turner
*Attorney, Agent, or Firm*—Morgan & Finnegan, L.L.P.

[57] ABSTRACT

The invention relates to the application of molybdenum alloys, which are superficially hardened by means of nitriding, for female dies and comparable construction components for extruding light and nonferrous metals. It is possible through the application of these materials to achieve distinct improvements over the materials used heretofore with respect to the tool life, extrusion rate and surface quality of the extruded material.

7 Claims, No Drawings

APPLICATION OF MOLYBDENUM ALLOYS

BACKGROUND OF INVENTION

1. Field of the Invention

The invention relates to the use of special materials for female dies and comparable construction components for extruding light and nonferrous metals.

2. Description of the Related Prior Art

The quality of female die materials for such applications is measured against the following important requirements:

High accuracy to size, i.e., high yield point and high creeping strength at the operating temperature of the die;

low susceptibility to thermomechanical fatigue or formation of cracks (an advantageous precondition for this is high thermal conductivity of the material);

high surface quality or low surface roughness of the extruded material;

applicability for high pressing rates;

adequate cold ductility; and high resistance to erosion/corrosion.

Primarily, hot-working steels, nickel-based superalloys and stellites have been used heretofore as die materials for such applications. Said materials have a comparatively low thermal conductivity and, therefore, are susceptible to thermomechanically induced fracture cracks. The surface quality of the extruded material obtained with the application of such female dies is much in need of improvement, for example as compared to the surface quality produced by means of ceramic female dies.

But the known drawbacks of the ceramic material, especially the low ductility and particularly the cold ductility highly limit the field of application for ceramic female dies as well.

DE-AS 17 58 508 describes the application of a composite material consisting of 20 to 85% by volume molybdenum and/or tungsten as the metallic component, the balance being zirconium oxide as the oxide-ceramic component, as material for the manufacture of female dies for extruding nonferrous and light metals.

The extruded material produced with such female dies is characterized by very good surface quality. A drawback is the not-always sufficient resistance to heat and creeping strength, and thus the early failure of the female dies.

Molybdenum alloys having the composition Mo, 1.2% Hf, 0.1% C or Mo, 0.5% Ti, 0.08% Zr, 0.02 to 0.04% C are used as female die materials for extruding copper alloys, whereby the applicability had to be limited to copper alloys with a copper content of <70% by weight.

The extrusion of light and nonferrous metals alloyed in different ways failed on account of the low resistance to erosion of said material; in particular, undesirable reactions of the extruded material with the female die material occurred.

It is known, for example from DE-AS 17 58 923 and DE-AS 17 58 924, to enhance the resistance to abrasion of "workpieces" consisting of metal alloys through superficial nitriding, whereby the metal alloys contain metals of three groups: niobium, tantalum and vanadium, in the one group, molybdenum and tungsten in the second group, and titanium in the third. The application of such "workpieces" as tools, especially as cutting tools, has been concretely stated and tested in the above-mentioned published references. The great number of materials explicitly mentioned therein includes a few molybdenum-containing materials as well, with a molybdenum content of 60% by weight at the most, preferably with molybdenum component of less than 45% by weight.

According to the patent specification, such materials are provided by such superficial nitriding with "certain mechanical properties, in particular resistance to wear", such properties having an effect in cutting tests of cutting tools made of such materials. Female extrusion dies with quality requirements highly different versus cutting tools have not been mentioned in said references.

Based on the general technical importance of surface nitriding for changing the surface properties of metallic materials, the nitriding of molybdenum materials has been more recently described with greater systematics in a paper by H. P. Martinz in the "Proceedings of the 13th International PLANSEE Seminar 1993", Vol. I, pp 632 ff. The paper demonstrates that the nitriding of molybdenum materials, as opposed to, for example the nitriding of iron materials, comprises a great number of different nitriding reactions, but also adverse reactions depending on the process conditions, which are specified in detail. The property changes in molybdenum alloys caused by nitriding, furthermore, have not been substantially elucidated by said work paper. They are substantially limited in the latter to the finding that nitride layers do not increase the resistance to oxidation of molybdenum at temperatures above 640° C.

SUMMARY OF THE INVENTION

An object of the present invention is to make available a female die material with enhanced properties for extruding nonferrous and light metals. Such a material is expected to satisfy in total the above-specified requirements in a superior way than accomplished with the materials previously used, mainly also in view of the molybdenum-based materials applied heretofore.

According to the invention, this and other objects are accomplished with molybdenum alloys that have been superficially hardened by means of nitriding.

The foregoing specific object and advantage of the invention is illustrative of those which can be achieved by the present invention and are not intended to be exhaustive or limiting of the possible advantages which can be realized. Thus, this and other objects and advantages of this invention will be apparent from the description herein or can be learned from practicing this invention, both as embodied herein or as modified in view of any variations which may be apparent to those skilled in the art. Accordingly, the present invention resides in the novel parts, constructions, arrangements, combinations and improvements herein shown and described.

DETAILED DESCRIPTION OF THE INVENTION

It is possible through the use of such materials for extruding nonferrous and light metals to distinctly enhance both the tool life and the molding rate and surface quality of the extruded material. For example, with aluminum and aluminum alloys, the molding rate can be increased by a distinct amount as compared to known female dies made of hot-working steel as previously used, with at least an equivalent surface quality of the molded material, and at least the same, but often even with an improved tool life of the die.

With copper and copper alloys, it is possible to quite substantially improve the tool life as compared to the nickel-based superalloys and stellites commonly used heretofore as materials for the female dies, with a comparatively superior surface quality of the extruded material even at a clearly higher molding rate.

The molybdenum alloys with 0.5 to 2% by weight hafnium, 0.04 to 0.2% by weight carbon, the balance molybdenum, which are known by the trade designation MHC, or the molybdenum alloy known by the designation TZM, with 0.4 to 0.55% by weight titanium, 0.06 to 0.12% by weight zirconium, 0.01 to 0.04% by weight carbon, the balance molybdenum, have been successfully used and found to be particularly suitable molybdenum alloys.

Gas nitriding, plasma nitriding or nitrogen-ion nitriding have been found to be particularly advantageous methods for nitriding the surface of the female dies.

The invention is explained in greater detail by the following examples:

EXAMPLE 1

From an MHC-alloy with a nominal composition of 1.2% by weight Hf, 0.1% by weight C, the balance Mo, round blanks were produced by means of commonly applied powder-metallurgical methods by pressing and sintering, and subsequently reshaped by 75% by forging. Female die inserts for a rectangular profile measuring 23.5 mm by 2 mm were manufactured from said forged blanks, whereby the diameter of the female die came to 60 mm and the length of the female die to 15 mm. The female die inserts were heated to 850° C. in a protective gas furnace under argon. Ammonia was introduced subsequently and the female die inserts were nitrided for 24 hours. On the average, the thickness of the nitride layer amounted to 9 μm and the micro-hardness of the die inserts came to 1950 HV 0.001. The female die inserts produced in said way were inserted in a female die holder made of hot-worked steel, and aluminum bars were extruded with said die.

As compared to female dies used heretofore and consisting of hot-worked steel, it was possible to increase the average tool life by a factor 1.6, at a 1.5 times higher extrusion rate, on the average. Furthermore, the extruded material produced with the female die inserts according to the invention showed a smoother surface than the material produced with female dies made of hot-working steel.

EXAMPLE 2

Female die inserts were produced from an MHC-alloy as specified in example 1 and subsequently nitrided for 6 hours in ammonia at 900° C. The mean thickness of the nitride layer came to 5 μm; the micro-hardness amounted to 1810 HV 0.001. Profiles were extruded with the female die inserts from low-oxygen copper. As compared to the female dies made of nickel-based superalloys as used heretofore, it was possible to increase the mean tool life by a factor 1.9 at a 1.2 times higher pressing rate. In this case too, the extruded material showed a smoother surface than with the female dies made of the nickel-based superalloy.

EXAMPLE 3

Female dies were produced from an MHC-alloy as in example 1 and nitrided. With the female die inserts so produced, profiles were extruded from the alloy Ms63. As compared to the female dies made of stellite as commonly used heretofore, it was possible to increase the mean tool life by a factor 2.8 at 1.2 times higher pressing rate. In the present case too, the extruded material showed a smoother surface than with the female dies made of stellite.

Although illustrative preferred embodiments have been described herein in detail, it should be noted and will be appreciated by those skilled in the art that numerous variations may be made within the scope of this invention without departing from the principle of this invention and without sacrificing its chief advantages. The terms and expressions have been used as terms of description and not terms of limitation. There is no intention to use the terms or expressions to exclude any equivalents of features shown and described or portions thereof and this invention should be defined in accordance with the claims which follow.

What is claimed is:

1. A die for extruding light and nonferrous metals, said die being made from a molybdenum alloy superficially hardened by means of nitriding.

2. The die according to claim 1, wherein the molybdenum alloy comprises 0.5 to 2% by weight hafnium, 0.04 to 0.2% by weight carbon, the balance molybdenum.

3. The die according to claim 1, wherein the molybdenum alloy comprises 0.04 to 0.55% by weight titanium, 0.06 to 0.12% by weight zirconium, 0.01 to 0.04% by weight carbon, the balance molybdenum.

4. The die according to claim 3, wherein the molybdenum alloy comprises 0.5% by weight titanium, 0.08% by weight zirconium, 0.04% by weight carbon, the balance molybdenum.

5. The die according to any one of claims 1 to 4, wherein the die is surface-treated by means of gas nitriding.

6. The die according to any one of claims 1 to 4, wherein the die is surface-treated by means of plasma nitriding.

7. The die according to any one of claims 1 to 4, wherein the die is surface-treated by means of nitrogen ion nitriding.

* * * * *